US009949598B2

(12) United States Patent
Masecchia

(10) Patent No.: US 9,949,598 B2
(45) Date of Patent: Apr. 24, 2018

(54) COMBINATION BATHTUB AND SHOWER BASE FACILITY

(71) Applicant: DISTRIBUTION AD WATERS (CAN) INC., Montréal (CA)

(72) Inventor: Tony Masecchia, Dorval (CA)

(73) Assignee: DISTRIBUTION AD WATERS (CAN) INC., Montréal (Québec) (CA)

( * ) Notice: Subject to any disclaimer, the term of this patent is extended or adjusted under 35 U.S.C. 154(b) by 0 days.

(21) Appl. No.: 14/884,113

(22) Filed: Oct. 15, 2015

(65) Prior Publication Data

US 2016/0106271 A1 Apr. 21, 2016

Related U.S. Application Data

(60) Provisional application No. 62/064,111, filed on Oct. 15, 2014.

(51) Int. Cl.

| | |
|---|---|
| ***A61H 33/02*** | (2006.01) |
| ***A47K 4/00*** | (2006.01) |
| ***A47K 3/02*** | (2006.01) |
| ***A47K 3/40*** | (2006.01) |

(52) U.S. Cl.

CPC ..... *A47K 4/00* (2013.01); *A47K 3/02* (2013.01); *A47K 3/405* (2013.01)

(58) Field of Classification Search

CPC ..... A47K 4/00; A47K 3/405
USPC ..... 4/546
See application file for complete search history.

(56) References Cited

U.S. PATENT DOCUMENTS

| | | | | | |
|---|---|---|---|---|---|
| 3,015,110 | A * | 1/1962 | Treand | A47K 4/00 | 4/663 |
| 3,533,200 | A * | 10/1970 | Zoebelein | A47K 4/00 | 4/663 |
| 3,955,219 | A * | 5/1976 | Finch | A47K 3/006 | 4/552 |
| 4,928,329 | A * | 5/1990 | Palmeri | A47K 4/00 | 4/552 |
| 4,955,093 | A * | 9/1990 | Klassen | A47K 3/04 | 4/579 |
| 5,001,787 | A | 3/1991 | Lynch | | |
| D319,093 | S * | 8/1991 | Dannenberg | D23/275 | |
| D320,435 | S * | 10/1991 | Dannenberg | D23/275 | |
| D325,623 | S * | 4/1992 | Lenahan | D23/275 | |
| 6,405,388 | B1 * | 6/2002 | Brown | A47K 4/00 | 4/553 |
| D616,073 | S * | 5/2010 | Kim | D23/273 | |
| 2012/0192349 | A1 * | 8/2012 | Torres | A47K 3/006 | 4/555 |

* cited by examiner

*Primary Examiner* — Huyen Le
(74) *Attorney, Agent, or Firm* — Baker & Hostetler LLP

(57) ABSTRACT

A combination bathtub/shower base facility including a bathtub unit, and a shower base, wherein the bathtub unit and the shower base are molded together as one unitary piece. The shower base is positioned downstream of any fluid overflowing from the tub. The facility also includes means for providing easy installation of the facility. The facility provides a shower, a bathtub, a relaxation room, a rainroom, a steam space, and a total immersion bath experience.

13 Claims, 7 Drawing Sheets

COMBINATION BATHTUB AND SHOWER BASE FACILITY

FIELD OF THE INVENTION

The present invention generally relates to bathtub and shower facilities. More particularly, it relates to a combination and shower base facility.

BACKGROUND

In some home installations, a bathtub enclosure can double as a shower stall. In other installations, a separate shower stall can be installed adjacently with respect to a bathtub. These latter installations can be labor-intensive, time-consuming and, therefore, costly to install.

U.S. Pat. No. 5,001,787 describes a combination bathtub/shower facility comprised of separately prefabricated shower and bathtub units which are structurally interconnected in such a manner as to maintain the structural, watertight, and aesthetic integrity of the facility. However, this separate prefabrication of the bathtub and shower units still results in a system that is complex to install There is therefore a need for an improved bathtub/shower base facility that addresses at least one of the problems of prior art systems described above.

SUMMARY OF THE INVENTION

An object of the invention is to provide a bathtub/shower base facility that addresses at least one of the above-mentioned needs.

According to the present invention, there is provided a combination bathtub/shower base facility comprising:

a bathtub unit; and a shower base, wherein the bathtub unit and the shower base are molded together as one unitary piece.

Preferably, the bathtub unit comprises:

a tub having an upper edge periphery;

a deck integrally joined with the upper edge periphery of the tub; and a first curb structure defining a tub dam integrally formed with the deck; and the shower base comprises:

a shower pan; and, a second curb structure defining a shower dam integrally formed with the shower pan, wherein the deck, tub dam and shower base are configured such that the shower base is positioned downstream of any fluid overflowing from the tub.

In some implementations, the molded one unitary piece is made of acrylic.

In some implementations, the molded one unitary piece is reinforced by at least one of fiberglass or wood agglomerate.

In some implementations, there is provided a supporting structure under the bathtub comprising a plurality of bars and/or tubes.

In some implementations, there is provided a wheeled assembly installable on a bottom portion of the facility for wheeled displacement thereof during installation.

In some implementations, the bath dam is integrally formed with the shower dam.

In some implementations, there is provided an apron structure integrally formed with the bathtub unit and the shower base and shaped to urge any fluid overflowing from the bathtub unit towards the shower base.

In some implementations, the shower base forms a drying zone adjacent to the bathtub unit. In other implementations, the shower base forms a wet zone adjacent to the bathtub unit.

In some embodiments, the deck comprises a portion providing a seating surface for a user.

In some implementations, there is provided pre-installed plumbing rough, speedways and drains.

In some implementations, there is provided centrally positioned drains in each of the bathtub unit and the shower base.

In some implementations, there is provided shared plumbing fixtures between the bathtub unit and the shower base.

BRIEF DESCRIPTION OF THE DRAWINGS

Other objects, advantages, and features will become more apparent upon reading the following non-restrictive description of the embodiments thereof, given for the purpose of exemplification only, with reference to the accompanying drawings in which:

FIGS. 7A to 7C are perspective views of a combination bathtub/shower base facility according to another embodiment, with sliding doors and board accessories removably insertable into the bathtub.

DETAILED DESCRIPTION

Figure 1:
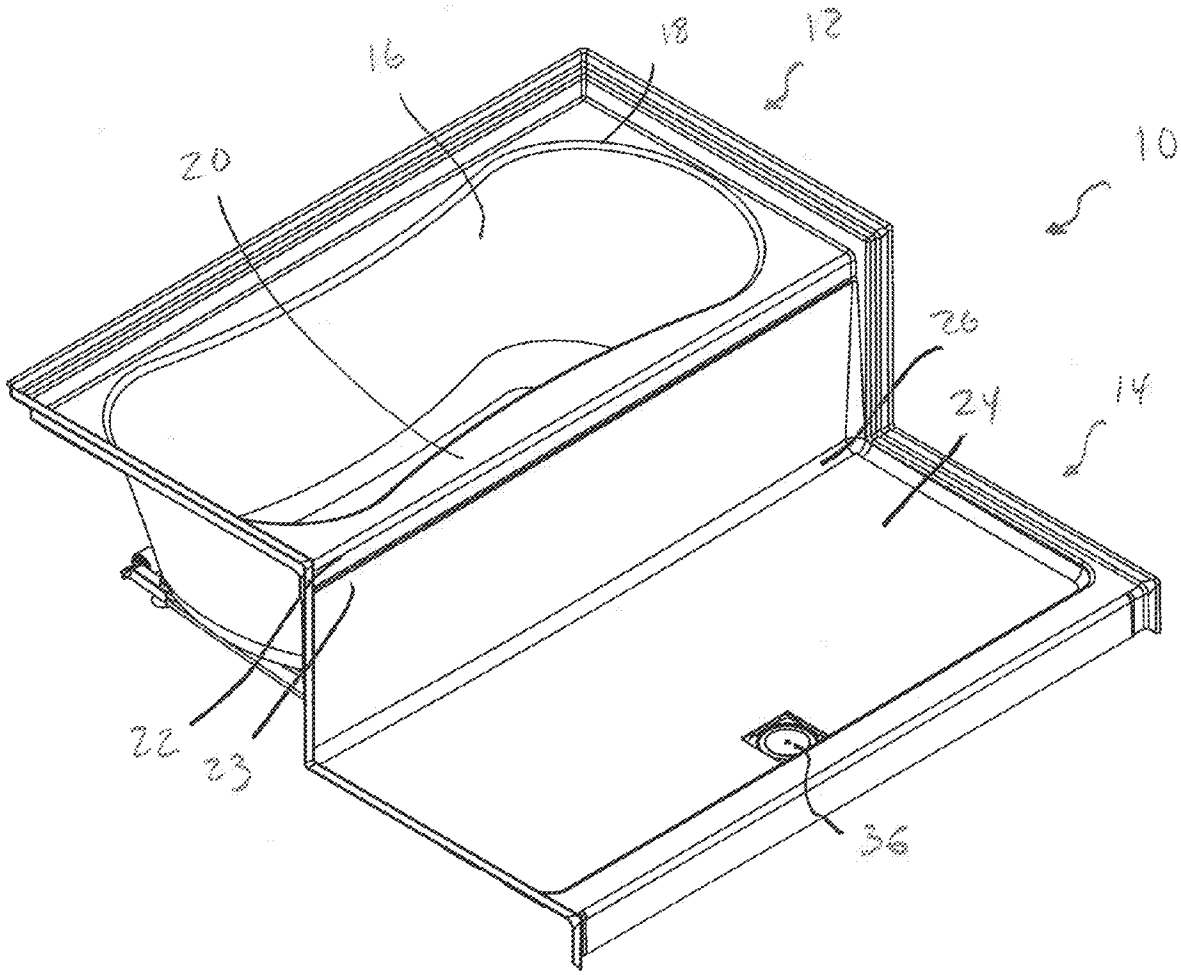
FIG. 1 is a top perspective view of a combination bathtub/shower base facility according to an embodiment.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Furthermore, although the present invention may be used with a bathtub/shower base facility, for example, it is understood that it may be used with other types of bathtub and shower facilities, for other purposes. For this reason, expressions such as “bathtub”, “shower base”, etc. as used herein should not be taken as to limit the scope of the present invention to being used with a bathtub/shower base in particular. These expressions encompass all other kinds of materials, objects and/or purposes with other types of bathtub/shower bases with which the present invention could be used and may be useful.

In addition, although the optional configurations as illustrated in the accompanying drawings comprises various components and although the optional configurations of the bathtub/shower base facility as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations thereinbetween, as well as other suitable geometrical configurations may be used for the bathtub/shower base facility, and corresponding parts, as briefly explained and as can be easily inferred herefrom, without departing from the scope of the disclosure.

According to the present invention, as shown in FIGS. 1 to 5, there is provided a combination bathtub/shower base facility 10 including a bathtub unit 12 and a shower base 14. The bathtub unit 12 and the shower base 14 are molded together as one unitary piece.

Preferably, the bathtub unit 12 includes a tub 16 having an upper edge periphery 18, a deck 20 integrally joined with the upper edge periphery 18 of the tub 16, and a first curb structure 22 defining a tub dam 23 integrally formed with the deck. The shower base 14 includes a shower pan 24 and a second curb structure 26 defining a shower dam integrally formed with the shower pan 24. The deck 20, tub dam 23 and shower base 14 are configured such that the shower base 12 is positioned downstream of any fluid overflowing from the tub 16.

In some implementations, the molded one unitary piece is made of acrylic.

In some implementations, the molded one unitary piece is reinforced by at least one of fiberglass or wood agglomerate.

Figure 2:
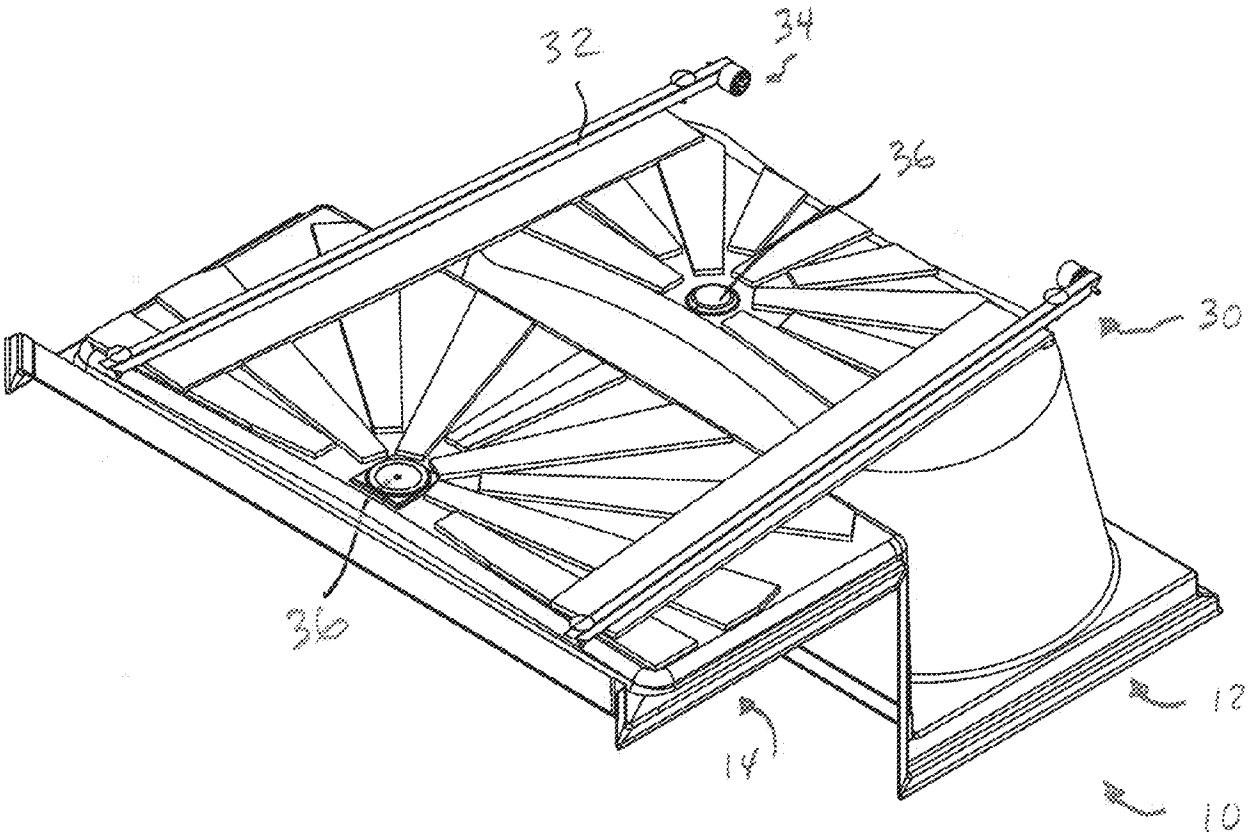
FIG. 2 is a bottom perspective view of the combination bathtub/shower base facility shown in FIG. 1.
Figure 3:
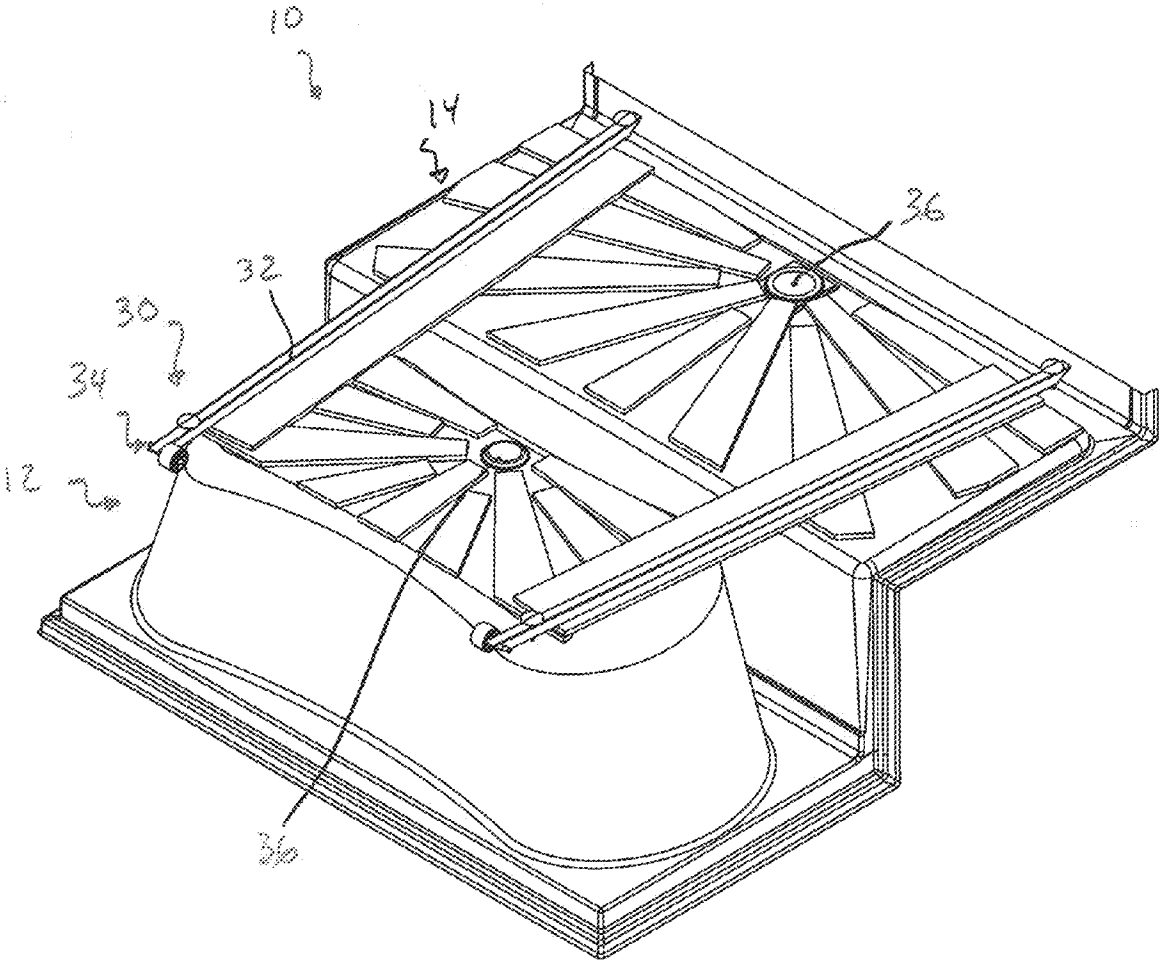
FIG. 3 is another bottom perspective view of the combination bathtub/shower base facility shown in FIG. 1.
Figure 4:
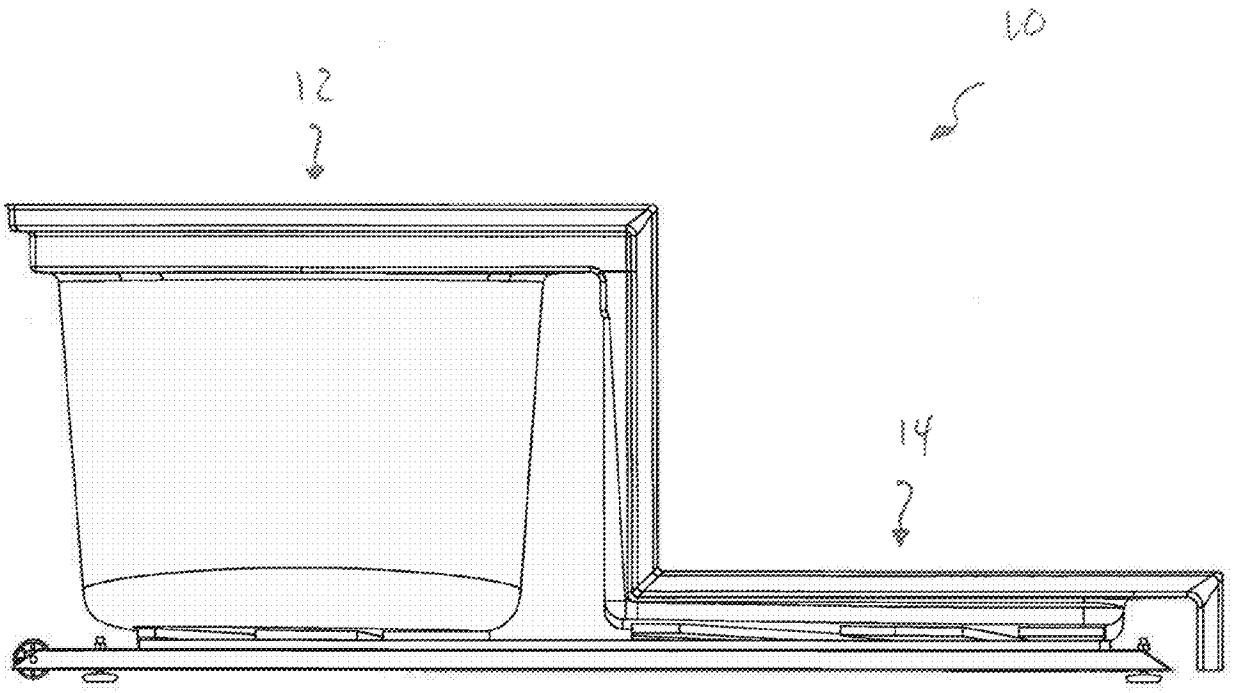
FIG. 4 is a side view of the combination bathtub/shower base facility shown in FIG. 1.
Figure 5:
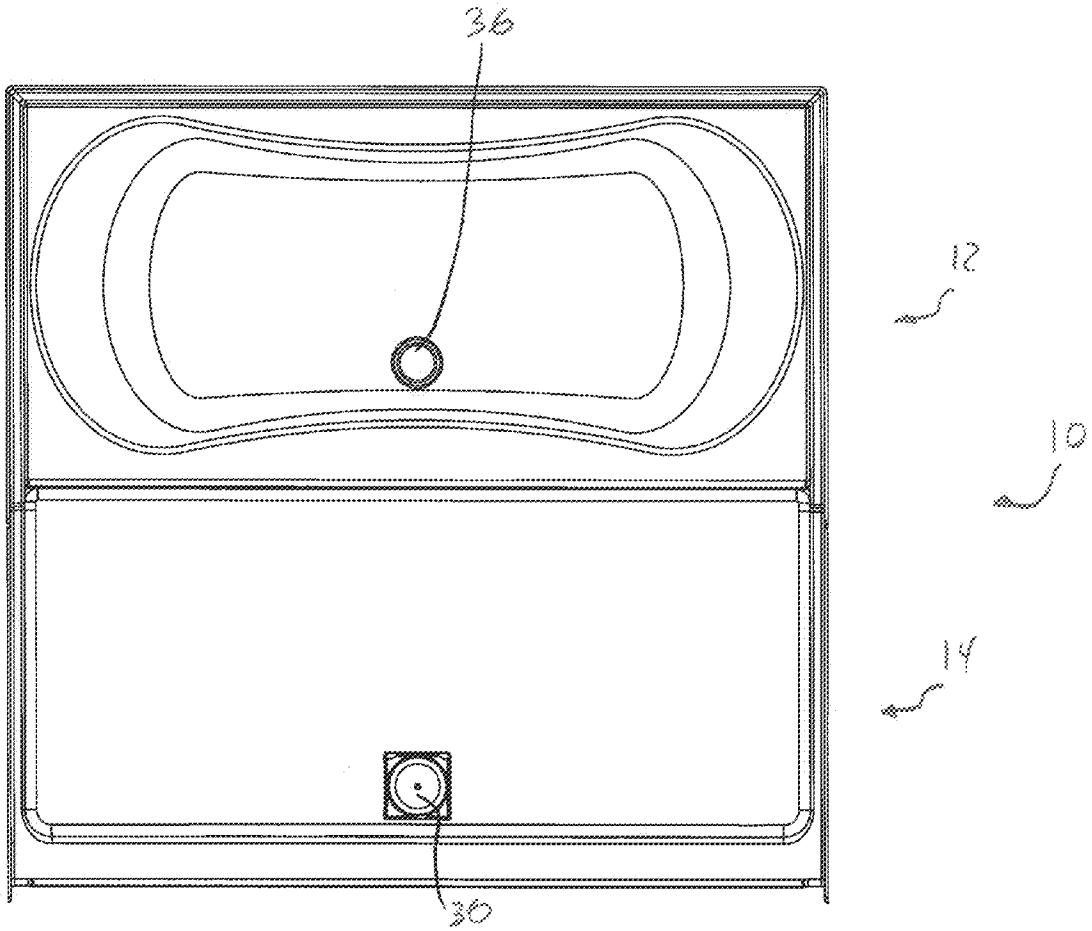
FIG. 5 is a top view of the combination bathtub/shower base facility shown in FIG. 1.

In some implementations, as better shown in FIG. 2 or 3, there is provided a supporting structure 30 under the bathtub comprising a plurality of bars and/or tubes 32.

In some implementations, there is provided a wheeled assembly 34 installable on a bottom portion of the facility for wheeled displacement thereof during installation.

In some implementations, the bath dam is integrally formed with the shower dam.

In some implementations, there is provided an apron structure integrally formed with the bathtub unit and the shower base and shaped to urge any fluid overflowing from the bathtub unit towards the shower base.

In some implementations, the shower base forms a drying zone adjacent to the bathtub unit. In other implementations, the shower base forms a wet zone adjacent to the bathtub unit.

In some embodiments, the deck comprises a portion providing a seating surface for a user.

In some implementations, there is provided pre-installed plumbing rough, speedways and drains 36.

In some implementations, there is provided centrally positioned drains in each of the bathtub unit and the shower base.

In some implementations, there is provided shared plumbing fixtures between the bathtub unit and the shower base. For example, there can be a shared shower rail and valve.

Figure 6B:
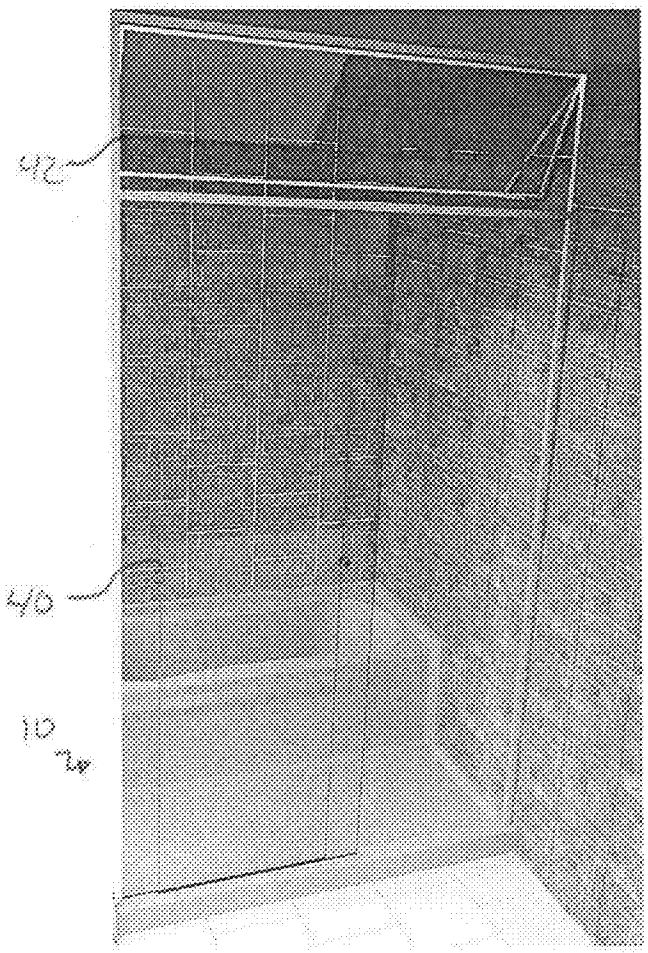
FIGS. 6A and 6B are perspective views of a combination bathtub/shower base facility according to another embodiment, with 9 foot high sliding doors and an upper vent.
Figure 6A:
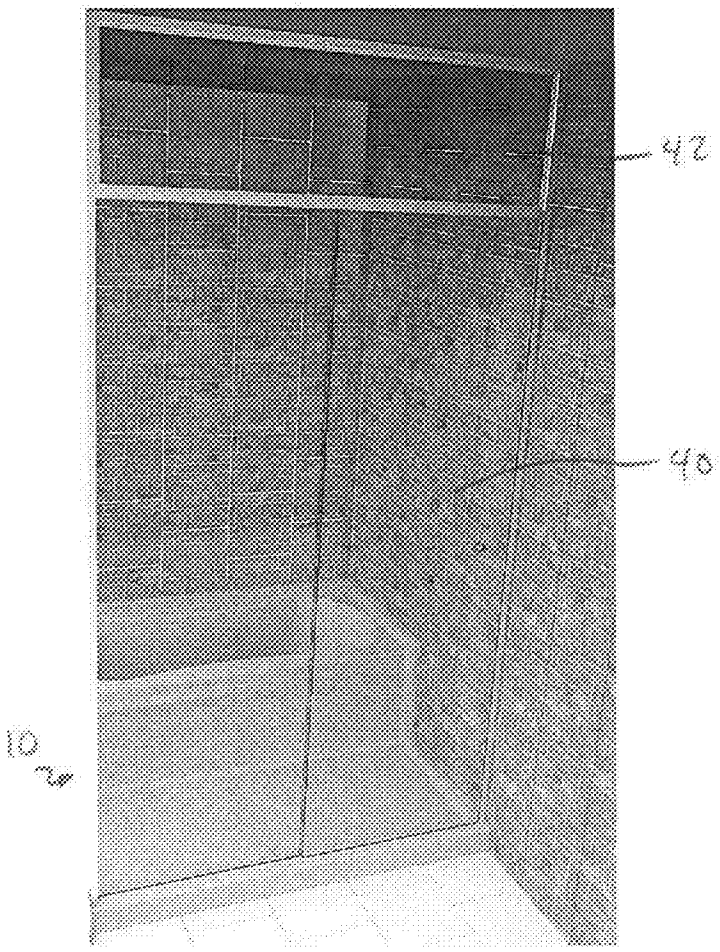

In one embodiment, as better shown in FIGS. 6A and 6B, the combination bathtub/shower base facility can include with 9 foot high sliding doors 40 and an upper vent 42.

Figure 7C:
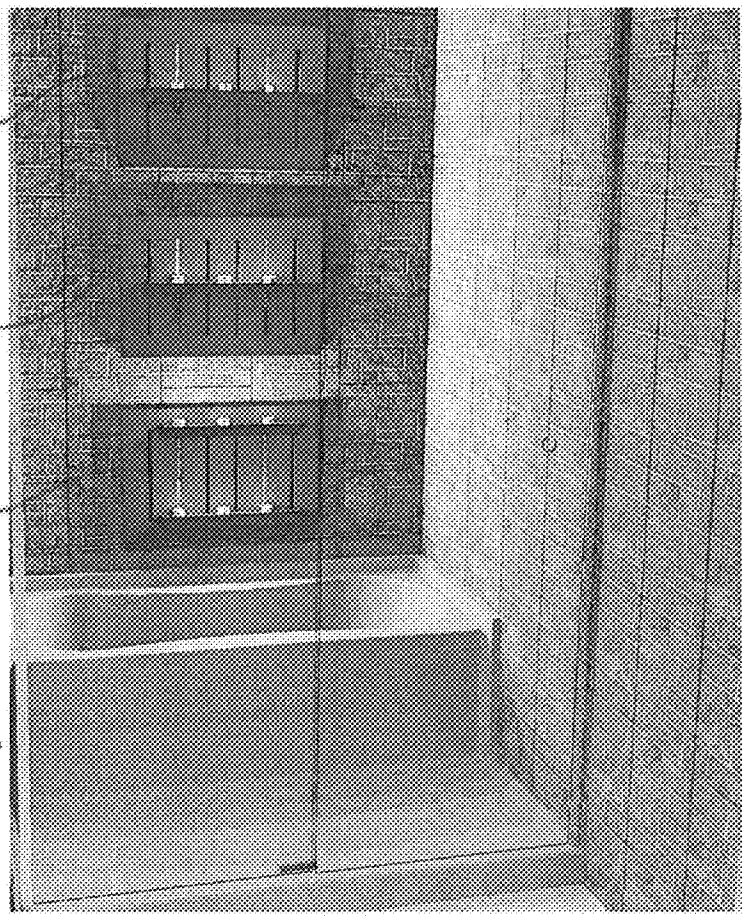
Figure 7B:
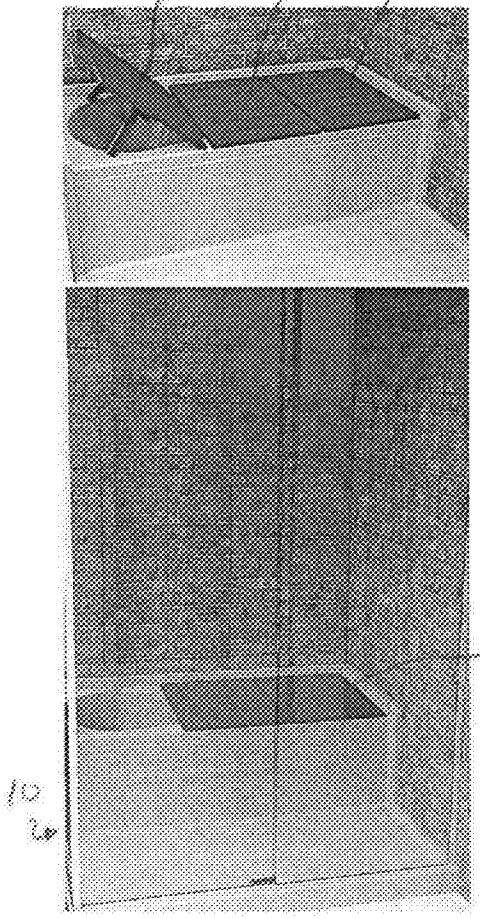

In another embodiment, another type of accessory can be provided as better shown in FIGS. 7A to 7C. Removable boards 50 can be provided and are insertable on the bathtub to use as a bench or as a platter for reading or having a drink when a user is in the tub, among other uses. These boards are reconfigurable and can also be optionally used as shelves to be placed on walls that are adjacent to the facility.

In one preferred embodiment, the facility provides a 54"×60" wet zone concept, with a bathroom area specifically designed for wet activities, including bathing showering and relaxing. The facility can provide an immersion bathing experience where overflowing bath water can flow towards the shower base. It can also provide a spa experience, with a wet area designed for relaxation.

Preferably, the facility is spacious enough for a two-person experience.

Preferably, the facility can be used for renovations or new constructions. The facility can expand the possibilities for bathtub installations usually confined to only a 5 foot bathtub, as it provides an efficient and compact design which optimizes small spaces. The facility allows for separate shower and bathing areas in small and narrow washrooms. The bathtub is not confined by a partition and there is provided additional shower space with elbow room.

Preferably, the facility provides comfortable drying, as warmth can be contained in the rainroom or shower base zone. The shower base can become a drying zone (drip guard) after bathing. The bathtub can be used as seating to help with drying.

Preferably, the facility is also family friendly, wherein children can bathe is a splash-friendly environment. A pet can also be bathed in the facility as a bigger splash area is provided. The drying area is practical as water can drain into the shower base drain.

Preferably, the bathtub is designed with a comfortable backrest. The bathtub shape is contoured for comfort. The bathtub edge can double as a shower bench on one side thereof.

Preferably, the one-piece unitary acrylic construction has no joints and hence no leaks. The acrylic material used is strong, lightweight, economical, easy to maintain, durable and provides thermal qualities that allow warmth retention.

Preferably, with respect to installation, the one-piece unit slides easily into place and one installation can fit all, when center drains are used (with no separate left or right side configurations for the drains.

In some optional embodiments, the facility can further provide a bubble jet system for the bathtub.

These are of course possible embodiments of the present invention. Other variations are possible without departing from the scope of the invention described herein. Additionally, the scope of the claims should not be limited by the preferred embodiments set forth in the examples, but should be given the broadest interpretation consistent with the description as a whole.

The invention claimed is:

1. A combination bathtub/shower base facility comprising:

a bathtub unit;

a shower base, and an apron structure, wherein the bathtub unit and the shower base are molded together as one unitary piece, wherein the bathtub unit comprises:

a tub having an upper edge periphery;

a deck integrally joined with the upper edge periphery of the tub; and a first curb structure defining a tub dam integrally formed with the deck;

wherein the shower base comprises:

a shower pan; and, a second curb structure defining a shower dam integrally formed with the shower pan, wherein the deck, tub dam and shower base are configured such that the shower base is positioned downstream of any fluid overflowing from the tub; and wherein the apron structure is integrally formed with the bathtub unit and the shower base and shaped to urge any fluid overflowing from the bathtub unit towards the shower base.

2. The combination bathtub/shower base facility according to claim 1, wherein the molded one unitary piece is made of acrylic.

3. The combination bathtub/shower base facility according to claim 1, wherein the molded one unitary piece is reinforced by at least one of fiberglass or wood agglomerate.

4. The combination bathtub/shower base facility according to claim 1, further comprising a supporting structure under the bathtub comprising a plurality of bars and/or tubes.

5. The combination bathtub/shower base facility according to claim 1, further comprising a wheeled assembly installable on a bottom portion of the facility for wheeled displacement thereof during installation.

6. The combination bathtub/shower base facility according to claim 1, wherein the bath dam is integrally formed with the shower dam.

7. The combination bathtub/shower base facility according to claim 1, wherein the shower base forms a drying zone adjacent to the bathtub unit.

8. The combination bathtub/shower base facility according to claim 1, wherein the deck comprises a portion providing a seating surface for a user.

9. The combination bathtub/shower base facility according to claim 1, further comprising pre-installed plumbing rough, speedways and drains.

10. The combination bathtub/shower base facility according to claim 1, further comprising centrally positioned drains in each of the bathtub unit and the shower base.

11. The combination bathtub/shower base facility according to claim 1, further comprising shared plumbing fixtures between the bathtub unit and the shower base.

12. The combination bathtub/shower base facility according to claim 1, further comprising at least one board element that is removably positionable over the tub.

13. The combination bathtub/shower base facility according to claim 12, wherein the at least one board element is reconfigurable as a shelf element.

* * * * *